US007651273B2

(12) United States Patent
Kanemitsu et al.

(10) Patent No.: US 7,651,273 B2
(45) Date of Patent: Jan. 26, 2010

(54) SEMISPHERICAL SHOE AND MANUFACTURING METHOD THEREFOR

(75) Inventors: Hiroshi Kanemitsu, Toyota (JP); Masaharu Hatta, Toyota (JP)

(73) Assignee: Taiho Kogyo Co., Ltd., Toyota-shi, Aichi (JP)

( * ) Notice: Subject to any disclaimer, the term of this patent is extended or adjusted under 35 U.S.C. 154(b) by 487 days.

(21) Appl. No.: 11/631,838

(22) PCT Filed: Aug. 23, 2005

(86) PCT No.: PCT/JP2005/015244

§ 371 (c)(1),
(2), (4) Date: Jan. 5, 2007

(87) PCT Pub. No.: WO2006/027949

PCT Pub. Date: Mar. 16, 2006

(65) Prior Publication Data

US 2008/0028877 A1 Feb. 7, 2008

(30) Foreign Application Priority Data

Sep. 3, 2004 (JP) ..... 2004-257059

(51) Int. Cl.
*F16C 5/00* (2006.01)
*F04B 39/00* (2006.01)

(52) U.S. Cl. ..... 384/26; 384/11; 92/71

(58) Field of Classification Search ..... 384/7, 384/11, 26, 38; 92/71, 159, 160; 74/60
See application file for complete search history.

(56) References Cited

U.S. PATENT DOCUMENTS 6,477,938 B1 * 11/2002 Nakayama et al. ..... 92/71

FOREIGN PATENT DOCUMENTS

| | | |
|---|---|---|
| JP | 62-133016 | 6/1987 |
| JP | 02-173212 | 7/1990 |
| JP | 03-158415 | 7/1991 |
| JP | 2001-153039 | 6/2001 |
| JP | 2001-153041 | 6/2001 |

* cited by examiner

*Primary Examiner*—Thomas R Hannon
(74) *Attorney, Agent, or Firm*—Flynn, Thiel, Boutell & Tanis, P.C.

(57) ABSTRACT

There is provided a semispherical shoe which is formed into a substantially semispherical shape by a convex semispherical surface 2 and a flat end surface 3, the semispherical surface having a slidably contacting surface 6 that is in slidable contact with a semispherical concave portion and non slidably contacting surfaces 7 and 8 that are not in slidable contact with the concave portion. When the semispherical shoe is manufactured, first, after a semispherical material having a semispherical surface following the concave portion has been formed, the surface of the portion that is to be the slidably contacting surface on the semispherical surface is quenched to expand the quenched portion from the original surface of the semispherical surface, whereby the sliding surface is formed on the surface of the expanded portion, and the other portions are made the non slidably contacting portions.

3 Claims, 1 Drawing Sheet

SEMISPHERICAL SHOE AND MANUFACTURING METHOD THEREFOR

BACKGROUND OF THE INVENTION

1. Field of the Invention

The present invention relates to a semispherical shoe formed into a substantially semispherical shape by a convex semispherical surface and a flat end surface, and a manufacturing method therefor. More particularly, it relates to a semispherical shoe in which the semispherical surface has a slidably contacting surface that is in slidable contact with a semispherical concave portion and a non slidably contacting surface that is not in slidable contact with the concave portion, and a manufacturing method therefor.

2. Background of Related Art

Conventionally, as a semispherical shoe used for a swash plate compressor, a semispherical shoe has been known which is formed into a substantially semispherical shape by a convex semispherical surface and a flat end surface, the semispherical surface having a slidably contacting surface that is in slidable contact with a semispherical concave portion and a non slidably contacting surface that is not in slidable contact with the concave portion (Patent Document 1). Patent Document 1: Japanese Patent Laid-Open No. 2001-153039

The semispherical concave portion provided in a piston of the swash plate compressor is generally formed so as to have the same curvature. On the other hand, the slidably contacting surface that is formed in the semispherical surface and is in slidable contact with the concave portion is formed into a ring shape in an intermediate portion between the top portion of semispherical surface and the end surface so as to surround the top portion, and is formed so as to have the same curvature as that of the semispherical concave portion.

In other words, the non slidably contacting surface that is not in slidable contact with the concave portion is formed at two places on the top portion side of semispherical surface and the end surface side, and the slidable contacting surface is formed in an intermediate portion therebetween.

The non slidably contacting surfaces at two places cannot be formed so as to have the same curved surface as that of the slidably contacting surface because they must not be in slidable contact with the concave portion. As a result, the semispherical surface has at least the curvature forming the non slidably contacting surface on the top portion side of semispherical surface, the curvature forming the slidably contacting surface, and the curvature forming the non slidably contacting surface on the end surface side of semispherical surface. In order to manufacture the semispherical surface having such a complicated curvature, the manufacturing process therefor must be complicated inevitably.

Also, since the manufacturing process is complicated, it is difficult to stably secure the width of the slidably contacting surface extending in the circumferential direction of semispherical surface in all of the semispherical shoes, and there is a danger of seizure because the surface pressure increases with a decrease in the width of slidably contacting surface.

The present invention has been made in view of the above circumstances, and accordingly an object thereof is to provide a semispherical shoe having a configuration capable of stably securing the width of slidably contacting surface in all of the semispherical shoes, and a manufacturing method for the semispherical shoe.

SUMMARY OF THE INVENTION

The invention provides a semispherical shoe which is formed into a substantially semispherical shape by a convex semispherical surface and a flat end surface, the semispherical surface having a slidably contacting surface that is in slidable contact with a semispherical concave portion and a non slidably contacting surface that is not in slidable contact with the concave portion, characterized in that one part of the semispherical surface is quenched, and thereby is expanded from the other portions, whereby the slidably contacting surface is formed on the surface of the expanded portion, and the surfaces of the other portions are made the non slidably contacting portions.

The invention also provides a manufacturing method for a semispherical shoe which is formed into a substantially semispherical shape by a convex semispherical surface and a flat end surface, the semispherical surface having a slidably contacting surface that is in slidable contact with a semispherical concave portion and a non slidably contacting surface that is not in slidable contact with the concave portion, characterized in that after a semispherical material having a semispherical surface following the concave portion has been formed, the surface of the portion that is to be the slidably contacting surface on the semispherical surface is quenched to expand the quenched portion from the original surface of the semispherical surface, whereby the sliding surface is formed on the surface of the expanded portion, and the other portions are made the non slidably contacting portions.

EFFECT OF INVENTION

In the invention, one part of the semispherical surface is quenched, and thereby is expanded from the other portions, whereby the slidably contacting surface is formed on the surface of the expanded portion, and the surfaces of the other portions are made the non slidably contacting portions. Therefore, by controlling the width of the portion that is to be quenched, the width of the slidably contacting surface can be set easily. Therefore, as compared with the conventional example, a danger of seizure can be reduced by stably securing the width of slidably contacting surface for all of the semispherical shoes.

Also, in the invention, when the semispherical material having the semispherical surface following the concave portion is formed, the semispherical material has only to be formed simply considering the curvature of the semispherical concave portion. Therefore, the manufacture is easy as compared with the case where the semispherical material is formed considering a plurality of curvatures.

Next, the surface of the portion that is to be the slidably contacting surface on the semispherical surface is quenched to expand the quenched portion from the original surface of the semispherical surface, whereby the sliding surface is formed on the surface of the expanded portion, and the other portions are made the non slidably contacting portions. At this time, namely, when the sliding surface is formed on the surface of the expanded portion, likewise, the curvature of the semispherical concave portion has only simply to be considered, so that the manufacture is easy. In addition, by controlling the width of the portion that is to be quenched, the width of the slidably contacting surface can be set easily, so that as compared with the conventional example, a danger of seizure can be reduced by stably securing the width of slidably contacting surface for all of the semispherical shoes.

DETAILED DESCRIPTION OF THE INVENTION

Figure 1:
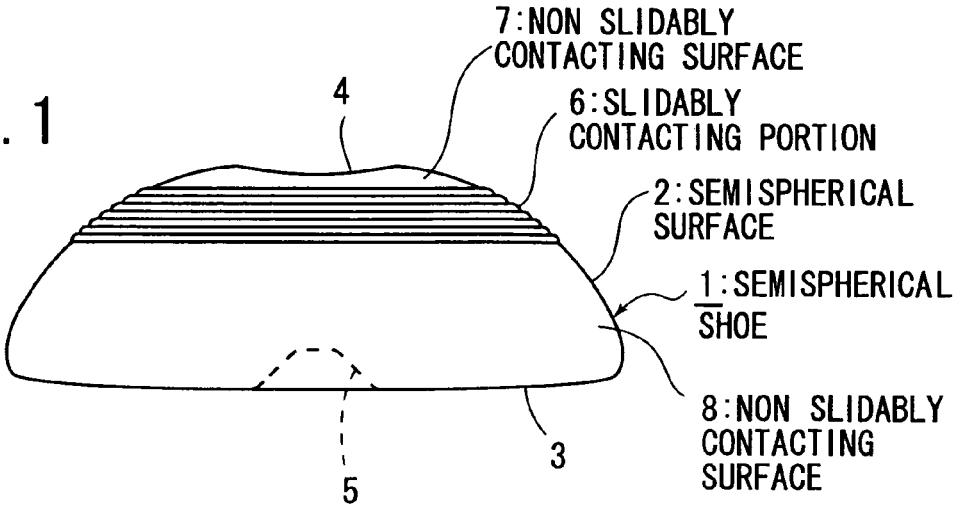
FIG. 1 is a front view showing an example of the present invention.

The present invention will be explained with reference to an example shown in the accompanying drawings. In FIG. 1, a semispherical shoe 1 used for a conventionally well-known swash plate compressor is interposed between a swash plate provided tiltingly on a rotating shaft, not shown, and a semispherical concave portion provided in a piston so that the piston can be reciprocatingly driven with the rotation of the swash plate.

The semispherical shoe 1 is formed into a substantially semispherical shape by a convex semispherical surface 2 and a flat end surface 3 so that the semicircular surface 2 is in slidable contact with the semispherical concave portion in the piston, and the end surface 3 is in slidable contact with the swash plate. Also, as necessary, a recess 4 is formed in the top portion of the semispherical surface 2, or an oil reservoir 5 consisting of a concave portion is formed in the central portion of the end surface 3.

On the semispherical surface 2, a ring-shaped slidably contacting surface 6 is formed along the circumferential direction in an intermediate portion of the semispherical surface 2 so that the slidably contacting surface 6 is in slidable contact with the semispherical concave portion. On the other hand, two places on the top portion side and the end surface 3 side of the slidably contacting surface 6 on the semispherical surface 2 form non slidably contacting surfaces 7 and 8 that are not in slidable contact with the semispherical concave portion.

Figure 2:
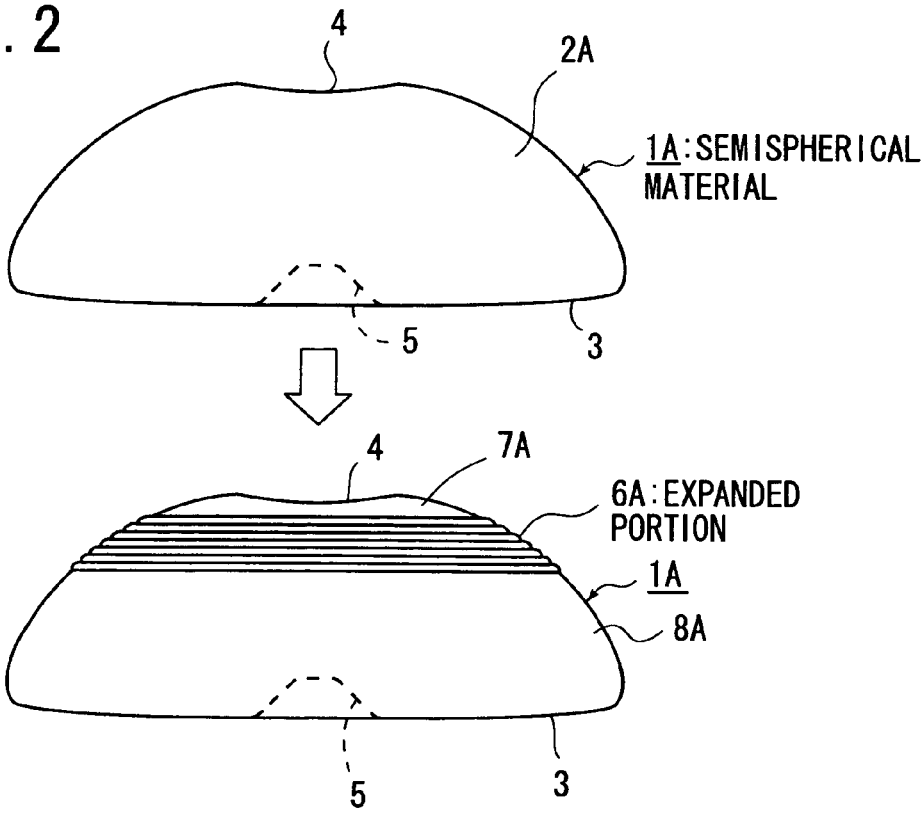
FIG. 2 is a process view for explaining a manufacturing process in accordance with the present invention.

As shown in FIG. 2, when the semispherical shoe 1 is manufactured, first, a semispherical material 1A having a semispherical surface 2A following the semispherical concave portion is formed. The semispherical material 1A can be manufactured, for example, by forging, and at this time, the recess 4 in the top portion and the oil reservoir 5 are formed by forging integrally.

At this time, when the semispherical material 1A is manufactured, it is forged so that the whole of the surface of the semispherical surface 2A follows the semispherical concave portion. Therefore, the manufacture is significantly easy as compared with the case where a semispherical surface consisting of a plurality of curvatures.

After the semispherical material 1A has been manufactured, then, the surface of the portion that is to be the slidably contacting portion on the semispherical surface 2A is quenched to expand the quenched portion from the original surface of the semispherical surface 2A, by which an expanded portion 6A is formed. The quenching is preferably performed by using laser. The irradiation portion irradiated with the laser becomes in a state in which the original surface of the semispherical surface 2A is quenched directly, and expands from the surface.

More specifically, the semispherical surface 2A of the semispherical material 1A manufactured of SUJ2 was irradiated with YAG laser straightly at intervals of 0.2 mm along the circumferential direction, by which the expanded portion 6A having a width W of about 2 mm as a whole was formed. At this time, the height of the expanded portion 6A is about 3 to 4 μm greater than the heights of portions 7A and 8A that have not been irradiated with the laser.

The output of the YAG laser was 50 W, and the condenser lens was adjusted so that the YAG laser is in focus at a position of a 2-mm depth with respect to the surface of the semispherical surface 2A. Therefore, the YAG laser was applied to the surface of the semispherical surface 2A in a defocused state.

Thus, by quenching the required position of the semispherical surface 2A of the semispherical material 1A in the required range, the expanded portion 6A having the necessary width W can be formed. Subsequently, the expanded portion 6A is subjected to lapping and buffing in succession. Thereby, the slidably contacting surface 6 having a proper curvature and width W, which is in slidable contact with the semispherical concave portion, can be formed. Also, the portions 7A and 8A that are not irradiated with the laser and hence not expanded can form the non slidably contacting surfaces 7 and 8 that are not in slidable contact with the semispherical concave portion.

In the above-described example, the expanded portion 6A is formed by quenching the sliding surface by laser. However, the quenching method is not limited to laser, and plasma beam etc. can also be used.

The invention claimed is:

1. A semispherical shoe which is formed into a substantially semispherical shape by a convex semispherical surface and a flat end surface, the semispherical surface having a slidably contacting surface that is in slidable contact with a semispherical concave portion and a non slidably contacting surface that is not in slidable contact with the concave portion, characterized in that one part of the semispherical surface is quenched, and thereby is expanded from the other portions, whereby the slidably contacting surface is formed on the surface of the expanded portion, and the surfaces of the other portions are made the non slidably contacting portions.

2. A manufacturing method for a semispherical shoe, comprising the step of forming a substantially semispherical shape by a convex semispherical surface and a flat end surface, the semispherical surface having a slidably contacting surface that is in slidable contact with a semispherical concave portion and a non slidably contacting surface that is not in slidable contact with the concave portion, characterized in that after a semispherical material having a semispherical surface following the concave portion has been formed, the surface of the portion that is to be the slidably contacting surface on the semispherical surface is quenched to expand the quenched portion from the original surface of the semispherical surface, whereby the sliding surface is formed on the surface of the expanded portion, and the other portions are made the non slidably contacting portions.

3. The manufacturing method for a semispherical shoe according to claim 2, characterized in that part that is to be the slidably contacting surface on the semispherical surface is irradiated with a laser to quench the part.

* * * * *